US009357850B2

(12) United States Patent
Murphy et al.

(10) Patent No.: US 9,357,850 B2
(45) **Date of Patent: *Jun. 7, 2016**

(54) SEATING UNIT CONVERTIBLE TO BED

(71) Applicant: Ultra-Mek, Inc., Denton, NC (US)

(72) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/831,214

(22) Filed: Aug. 20, 2015

(65) Prior Publication Data

US 2015/0351554 A1 Dec. 10, 2015

Related U.S. Application Data

(63) Continuation of application No. 14/173,513, filed on Feb. 5, 2014, now Pat. No. 9,144,319.

(60) Provisional application No. 61/907,038, filed on Nov. 21, 2013.

(51) Int. Cl.
*A47C 17/04* (2006.01)
*A47C 17/16* (2006.01)
(Continued)

(52) U.S. Cl.
CPC ..... *A47C 17/2076* (2013.01); *A47C 7/402* (2013.01); *A47C 17/04* (2013.01); *A47C 17/16* (2013.01); *A47C 17/22* (2013.01)

(58) Field of Classification Search
CPC .... A47C 17/04; A47C 17/132; A47C 17/136; A47C 17/16; A47C 17/161; A47C 17/162; A47C 17/163; A47C 17/165; A47C 17/1655; A47C 17/17; A47C 17/175; A47C 17/1756; A47C 17/20; A47C 17/207; A47C 17/2076; A47C 17/213; A47C 17/22; A47C 17/225
USPC ..... 5/12.1, 13, 14, 28–32.1, 35, 36, 37.1, 5/41, 42, 42.1, 43, 44.1, 47, 48, 56, 312, 5/313.1, 314.1
See application file for complete search history.

(56) References Cited

U.S. PATENT DOCUMENTS 213,512 A 3/1879 Landis et al.
577,138 A 2/1897 Hubbard et al.
(Continued)

FOREIGN PATENT DOCUMENTS

EP 1913846 4/2008
GB 626821 7/1949

OTHER PUBLICATIONS

International Search Report and Written Opinion for related PCT Application No. PCT/US2014/038908, date of mailing Oct. 16, 2014.

*Primary Examiner* — Robert G. Santos
(74) *Attorney, Agent, or Firm* — Myers Bigel & Sibley, P.A.

(57) ABSTRACT

A seating unit having a foldable bed includes: a base with an internal cavity and a rear wall; a foldable bed that includes separate and distinct head, intermediate and seat sections, wherein in a folded position, the intermediate and seat sections are generally horizontally disposed and positioned in vertically stacked relationship, and the head section is generally vertically disposed and positioned adjacent the rear wall of the base, and in an unfolded position, the head, intermediate and seat sections are generally horizontally disposed and in serial alignment with each other; and a bed folding mechanism that is attached to the base and the head, intermediate and seat sections that controls the movement of the bed between the folded and unfolded positions.

22 Claims, 12 Drawing Sheets

(51) Int. Cl.

| | |
|---|---|
| ***A47C 17/207*** | (2006.01) |
| ***A47C 17/22*** | (2006.01) |
| ***A47C 7/40*** | (2006.01) |

(56) References Cited

U.S. PATENT DOCUMENTS

| | | | | |
|---|---|---|---|---|
| 640,647 | A | 1/1900 | Gannett et al. | |
| 706,178 | A | 8/1902 | Hoey | |
| 1,018,593 | A | 2/1912 | Swanson et al. | |
| 1,043,071 | A | 11/1912 | Coopersmith | |
| 1,218,608 | A | 3/1917 | Arnold | |
| 1,509,863 | A | 9/1924 | Erickson | |
| 1,690,797 | A | 11/1928 | Schwab | |
| 1,945,186 | A | 1/1934 | Frank et al. | |
| D151,983 | S | 12/1948 | Guertin | |
| D151,984 | S | 12/1948 | Guertin | |
| D160,390 | S | 10/1950 | Hubbert | |
| 2,577,741 | A | 12/1951 | Creveling et al. | |
| 2,579,577 | A | 12/1951 | Hill et al. | |
| 2,582,703 | A | 1/1952 | Kirshbaum | |
| 2,625,204 | A | 1/1953 | Beichman | |
| 2,635,678 | A | 4/1953 | Basil et al. | |
| 2,654,896 | A | 10/1953 | Coopersmith | |
| 2,664,145 | A | 12/1953 | Pennell et al. | |
| 2,696,870 | A | 12/1954 | Wimende et al. | |
| 2,740,131 | A | 4/1956 | Vogel et al. | |
| 2,786,213 | A | 3/1957 | Penneh et al. | |
| 2,804,122 | A | 8/1957 | Baum et al. | |
| 2,812,227 | A | 11/1957 | Hill et al. | |
| 2,838,097 | A | 6/1958 | Gleitsman et al. | |
| 2,876,461 | A | 3/1959 | Bontempi et al. | |
| 2,877,830 | A | 3/1959 | Smith et al. | |
| 2,950,753 | A | 6/1960 | Gleitsman et al. | |
| 2,988,757 | A | 6/1961 | Pennell et al. | |
| 3,005,998 | A | 10/1961 | Zimmerspitz | |
| 3,114,574 | A | 12/1963 | Pryale et al. | |
| 3,121,237 | A | 2/1964 | Brisdisi et al. | |
| 3,145,049 | A | 8/1964 | Duke et al. | |
| 3,227,112 | A | 1/1966 | Wiseman et al. | |
| 3,432,203 | A | 3/1969 | Cavalli et al. | |
| 3,451,718 | A | 6/1969 | Kaufman et al. | |
| 3,458,877 | A | 8/1969 | Edwards | |
| 3,506,984 | A | 4/1970 | Ellis, Jr. et al. | |
| 3,634,893 | A | 1/1972 | Hern et al. | |
| 3,908,210 | A | 9/1975 | Alembik | |
| 3,942,835 | A | 3/1976 | Harrison | |
| 4,032,999 | A | 7/1977 | Pringle | |
| 4,083,599 | A | 4/1978 | Gaffney | |
| 4,200,941 | A | 5/1980 | Gill et al. | |
| 4,557,080 | A | 12/1985 | Walworth et al. | |
| 4,577,902 | A | 3/1986 | Crum | |
| 4,651,363 | A | 3/1987 | Mizelle | |
| 4,669,778 | A | 6/1987 | Rogers, Jr. | |
| 4,696,069 | A | 9/1987 | Crosthwaite | |
| 4,737,996 | A | 4/1988 | Tiffany | |
| 4,834,449 | A | 5/1989 | Engelman | |
| 4,946,222 | A | 8/1990 | Matson | |
| 5,087,094 | A | 2/1992 | Rogers, Jr. | |
| 5,160,183 | A | 11/1992 | Rusyniak | |
| 5,186,518 | A | 2/1993 | Pine | |
| 5,195,194 | A | 3/1993 | Bradley et al. | |
| 5,394,573 | A | 3/1995 | Laughlin et al. | |
| 6,904,628 | B2 | 6/2005 | Murphy et al. | |
| 7,547,182 | B2 | 6/2009 | Hogue et al. | |
| 7,549,182 | B2 | 6/2009 | Murphy | |
| 8,011,034 | B2 | 9/2011 | Hoffman et al. | |
| 8,201,290 | B1 | 6/2012 | Hooley et al. | |
| 8,438,676 | B2 | 5/2013 | Murphy | |
| 8,739,330 | B2 | 6/2014 | Smith et al. | |
| 8,893,323 | B2 | 11/2014 | Garland | |
| 8,997,273 | B2 | 4/2015 | Murphy et al. | |
| 9,144,319 | B2 * | 9/2015 | Murphy | A47C 17/04 |
| 2003/0070225 | A1 | 4/2003 | Murphy et al. | |
| 2007/0283491 | A1 | 12/2007 | Murphy | |
| 2009/0235452 | A1 | 9/2009 | Hoffman et al. | |
| 2011/0010846 | A1 | 1/2011 | Murphy | |
| 2011/0010847 | A1 | 1/2011 | Murphy | |
| 2013/0097774 | A1 | 4/2013 | Garland | |
| 2014/0345044 | A1 | 11/2014 | Murphy et al. | |
| 2015/0135432 | A1 | 5/2015 | Murphy et al. | |
| 2015/0351554 | A1 * | 12/2015 | Murphy | A47C 17/04 5/29 |
| 2016/0051057 | A1 * | 2/2016 | Murphy | A47C 17/134 5/29 |

* cited by examiner

SEATING UNIT CONVERTIBLE TO BED

RELATED APPLICATION

The present invention is a continuation of U.S. Pat. No. 9,144,319, issued Sep. 29, 2015, which claims the benefit of priority U.S. Provisional Patent Application No. 61/907,038, filed on Nov. 21, 2013, the disclosure of which is hereby incorporated herein in its entirety.

FIELD OF THE INVENTION

The present invention relates generally to furniture, and more specifically a furniture unit that is convertible into a bed.

BACKGROUND OF THE INVENTION

Furniture units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other furniture units lack a complete mattress, but instead are constructed of separate sections that serve as support surfaces of the sofa and unfold to form a flat, mattress-like sleeping surface. Different examples of this basic concept are shown in U.S. Pat. No. 2,740,131 to Vogel et al., U.S. Pat. No. 5,195,194 to Bradley, U.S. Pat. No. 7,547,182 to Murphy, and U.S. Pat. No. 8,438,676 to Murphy, the disclosure of each of which is hereby incorporated herein in its entirety. The bed shown in the latter of the Murphy patents includes three separate sections that serve as the mattress of the bed: a seat section; an intermediate section; and a head section. A folding mechanism controls the movement of the head, intermediate and seat sections between a folded position, in which the head, intermediate and seat sections are positioned in a vertically stacked relationship, with the head section below the intermediate section and the seat section above the intermediate section, and with the head and intermediate sections being positioned in the cavity of the housing and the seat section serving as the "seat" for the sofa, and an unfolded position, in which the head, intermediate and seat sections are horizontally disposed and serially aligned to form a sleeping surface.

In spite of the existence of these different foldable beds, it may be desirable to offer additional furniture units that can house foldable beds.

SUMMARY OF THE INVENTION

As a first aspect, embodiments of the invention are direction to a seating unit that includes a foldable bed. The seating unit comprises: a base with an internal cavity and a rear wall; a foldable bed that includes separate and distinct head, intermediate, and seat sections, wherein in a folded position, the intermediate and seat sections are generally horizontally disposed and positioned in vertically stacked relationship, and the head section is generally vertically disposed and positioned adjacent the rear wall of the base, and in an unfolded position, the head, intermediate and seat sections are generally horizontally disposed and in serial alignment with each other; and a bed folding mechanism that is attached to the base and the head, intermediate and seat sections that controls the movement of the bed between the folded and unfolded positions.

As a second aspect, embodiments of the present invention are directed to seating unit that includes a foldable bed, the seating unit comprising: a base with an internal cavity; a foldable bed that includes a plurality of sections, wherein in a folded position, the bed sections are folded relative to each other and stored within the base cavity, with a seat section serving as the seat for the seating unit, and in an unfolded position, the bed sections are generally horizontally disposed and in serial alignment with each other, with the seat section being positioned forwardly of the base; a bed folding mechanism that is attached to the base and the bed sections that controls the movement of the bed between the folded and unfolded positions; and a backrest cushion assembly attached to the base that is movable between raised and lowered positions.

As a third aspect, embodiments of the present invention are directed to a seating unit that includes a foldable bed, the seating unit comprising: a base with an internal cavity; a foldable bed that includes a plurality of sections, wherein in a folded position, the bed sections are folded relative to each other and stored within the base cavity, with a seat section serving as the seat for the seating unit, and in an unfolded position, the bed sections are generally horizontally disposed and in serial alignment with each other, with the seat section being positioned forwardly of the base; a bed folding mechanism that is attached to the base and the bed sections that controls the movement of the bed between the folded and unfolded positions; and a center leg assembly mounted to the intermediate section, the center leg assembly residing between the intermediate section and the seat section in the folded position and extending to support the intermediate section from underneath in the unfolded position.

DETAILED DESCRIPTION OF EMBODIMENTS OF THE INVENTION

Figure 1:
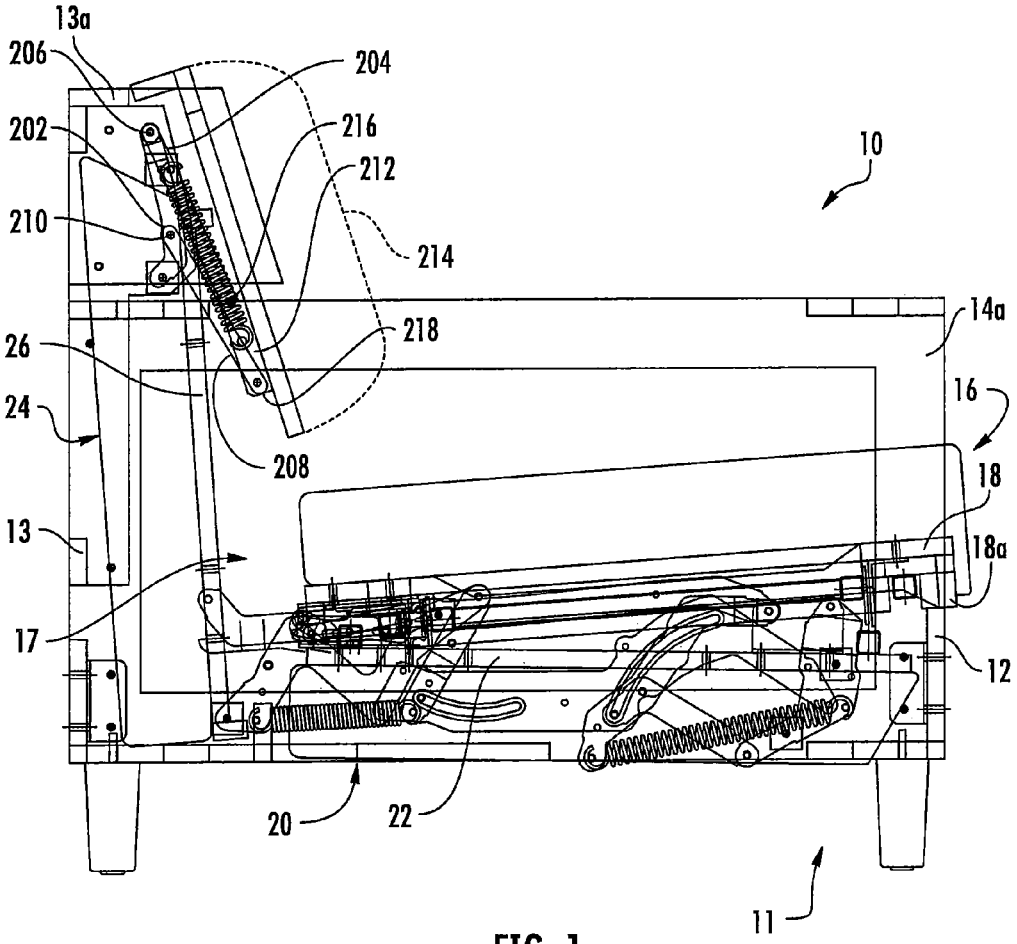
FIG. 1 is a side view of a seating unit according to embodiments of the present invention, with the bed shown in its folded position and the backrest shown in a lowered position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Referring now to the figures, a seating unit, designated broadly at 10, is illustrated in FIGS. 1-13. Referring first to FIGS. 1 and 5, the seating unit 10 includes a base 11 having a front wall 12, a rear wall 13 with a backrest 13*a*, and opposed side walls 14 with arms 14*a* (see FIG. 5); these walls 12, 13 14 define a cavity 17. A foldable bed 15 includes a seat section 16 with an underlying seat frame 18, an intermediate section 20 with an underlying intermediate panel 22, and a head section 24 with an underlying head panel 26. The intermediate and head panels 22, 26 are planar panels, typically formed of wood, that underlie most or all of cushions that provide a comfortable surface for sleeping. The seat frame 18 comprises two open square subframes and is described in some detail in co-assigned and co-pending U.S. patent application Ser. No. 13/900,311, filed on May 22, 2013, the disclosure of which is hereby incorporated herein in its entirety.

Figure 4:
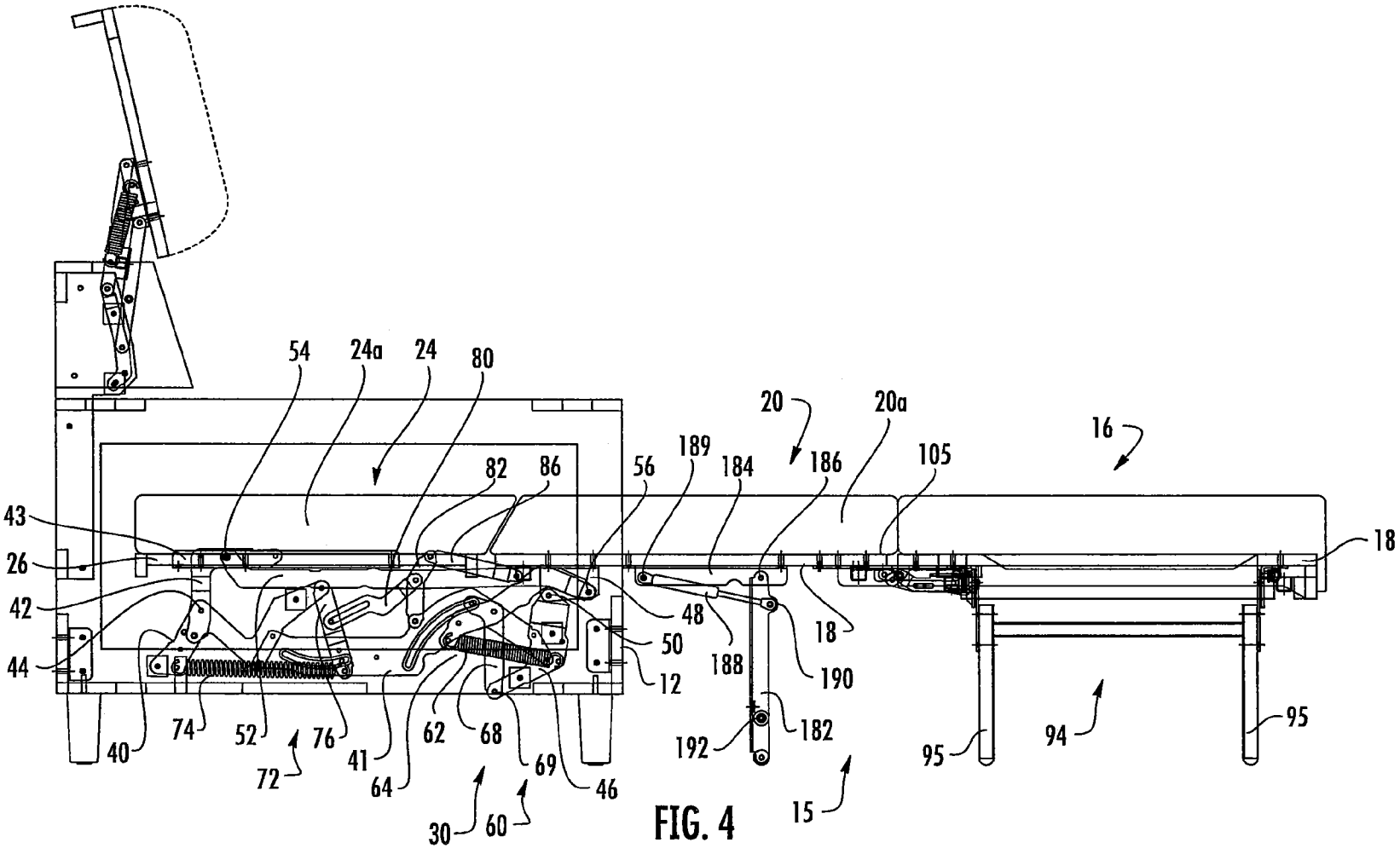
FIG. 4 is a side view of the seating unit of FIG. 1 with the bed in its unfolded position.
Figure 5:
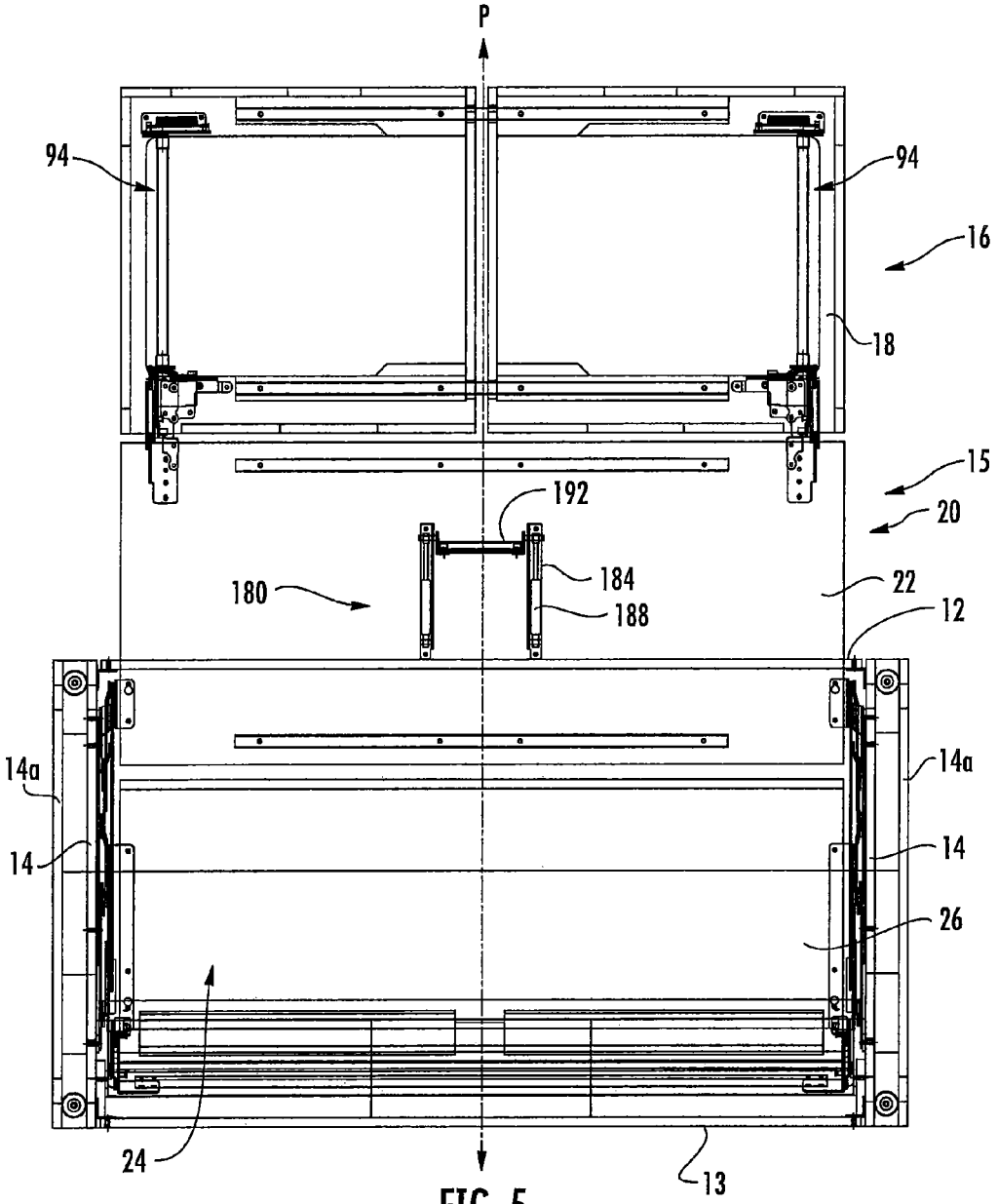
FIG. 5 is a top view of the seating unit of FIG. 1 with the bed in the unfolded position of FIG. 4.

The bed 15 is movable between a folded position, in which the seat and intermediate sections 16, 20 are generally horizontally disposed and positioned in vertically stacked relationship, and the head section 24 is generally vertically disposed and positioned adjacent the rear wall 13 and backrest 13*a* of the base 11 (see FIGS. 1 and 2), and an unfolded position, in which the seat, intermediate and head sections 16, 20, 24 are horizontally disposed and serially aligned to form a sleeping surface (see FIGS. 4 and 5).

The movement of the sections 16, 20, 24 of the bed 15 is controlled by a pair of bed folding mechanisms 30, which will be described in greater detail below. The bed folding mechanisms 30 are mirror images of each other about a vertical plane P (FIG. 5) that bisects the seating unit 10 normal to the front wall 12; as such, only one bed folding mechanism 30 will be described herein, with the understanding that the description is applicable to the other mechanism also. Two leg folding mechanisms 100 are also mirror images of each other about the plane P, such that only one will be described in detail hereinbelow.

For the sake of clarity, the bed 15 will be described initially in the unfolded position of FIGS. 4 and 5; movement to the folded position of FIGS. 1 and 2 will then follow. As used herein to describe the relative positions of components, the terms "lateral", "outward" and derivatives thereof indicate the directions defined by a vector beginning at the vertical plane P that bisects the seating unit 10 normal to the front wall 12 and extending toward either side wall 14. Conversely, the terms "inward", "inboard" and derivatives thereof indicate the direction opposite the "outward" direction. Together, the "inward" and "outward" directions comprise the "transverse" axis of the seating unit 10. The "rear" of the unfolded bed 15 is located at the end of the bed 15 nearest the rear wall 13 and backrest 13*a* of the base 11 (i.e., toward the head section 24), and the "front" of the bed 15 is located at the end nearest the seat section 16. The "front" and "rear" directions comprise the "longitudinal" axis of the bed 15.

In addition, some components of the bed folding mechanisms 30 are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to FIGS. 4, 5, 6C and 6D, the bed folding mechanism 30 includes a front mounting bracket 41 that is fixed to the inner surface of the side wall 14. A serpentine rear mounting bracket 40 is fixed to a rear portion of the front mounting bracket 41. An L-shaped head section link 42 is connected to the rear mounting link 40 at a pivot 44; the head section link 42 extends upwardly from the pivot 44, then forwardly, where it is fixed to a head section bracket 43 that is in turn fixed to the lateral edge of the head panel 26. The pivot 44 provides an axis about which the head section 24 rotates in moving between the folded and unfolded positions.

The front mounting bracket 41 includes two arcuate slots 41*a*, 41*b*. An angled extension 46 is mounted generally vertically to the forward end of the front mounting bracket 41. An intermediate section bracket 48 is fixed to the underside of the intermediate panel 22 and is attached to the upper end of the extension 46 at a pivot 50. The pivot 50 defines an axis about which the intermediate section 20 rotates in moving between the folded and unfolded positions.

A connecting link 52 is attached to the head section link 42 at a pivot 54 and extends forwardly therefrom to a pivot 56 with the intermediate section bracket 48. The connecting link 52 ties together the movements of the head section 24 and the intermediate section 20 in moving between the folded and unfolded positions.

The seating unit 10 includes two different linkages that can assist the user in folding and unfolding the bed 15: an unfolding assist assembly 60 and a folding assist assembly 72. Referring to FIG. 6C, the unfolding assist assembly 60 includes a spring 62 that is attached at its forward end to the vertex of the extension 46. A spring link 64 is attached at its forward end to the intermediate section bracket 48 at the pivot 56 and extends downwardly and rearwardly to attach to the rear end of the spring 62. A control link 68 is attached to the lower end of the extension 46 at a pivot 69 and extends upwardly to a pivot 67 with the spring link 64. The control link 68 also includes a pin 68*a* that is received in the forward end of the slot 41*a* of the front mounting bracket 41. In the unfolded position of FIGS. 4 and 6C, the spring 62 is substantially, if not entirely, relaxed.

Referring still to FIG. 6C, the folding assist assembly 72 includes a spring 74 that is attached to the rear end of the rear mounting bracket 40 and extends forwardly therefrom. A spring link 76 is attached at its lower end to the spring 74 and at its upper end to the forward end of the rear mounting bracket 40 at a pivot 78. The spring link 76 includes two pins 76*a*, 76*b*; the pin 76*a* is received in the slot 41*b* of the front mounting bracket 41. A slotted link 80 has a slot 80*a* that receives the pin 76*b* at its rear end. A control link 82 is attached to the front mounting bracket 41 at a pivot 84 and extends generally upwardly therefrom; the slotted link 80 is attached to a central portion of the control link 82 at a pivot 83. A transition link 86 is attached at its rear end to the upper end of the control link 82 at a pivot 88 and extends downwardly and forwardly therefrom to a pivot 90 with the connecting link 52. In the unfolded position of FIGS. 4 and 6C, the spring 74 is in tension.

Referring now to FIGS. 7-13, the bed 15 includes two generally U-shaped legs 94. The legs 94 are mounted below the seat section 16 and move between a folded position, in which the uprights 95 of the legs 94 extend transversely toward each other and are generally horizontally disposed beneath the seat section 16, and an unfolded position, in which the uprights 95 of the legs 94 are vertically disposed beneath the seat section 16 and rest on an underlying surface to provide support for the seat section 16 from underneath. In the illustrated embodiment, the distance between the uprights 95 of the legs 94 is between about 16 and 24 inches.

Figure 13:
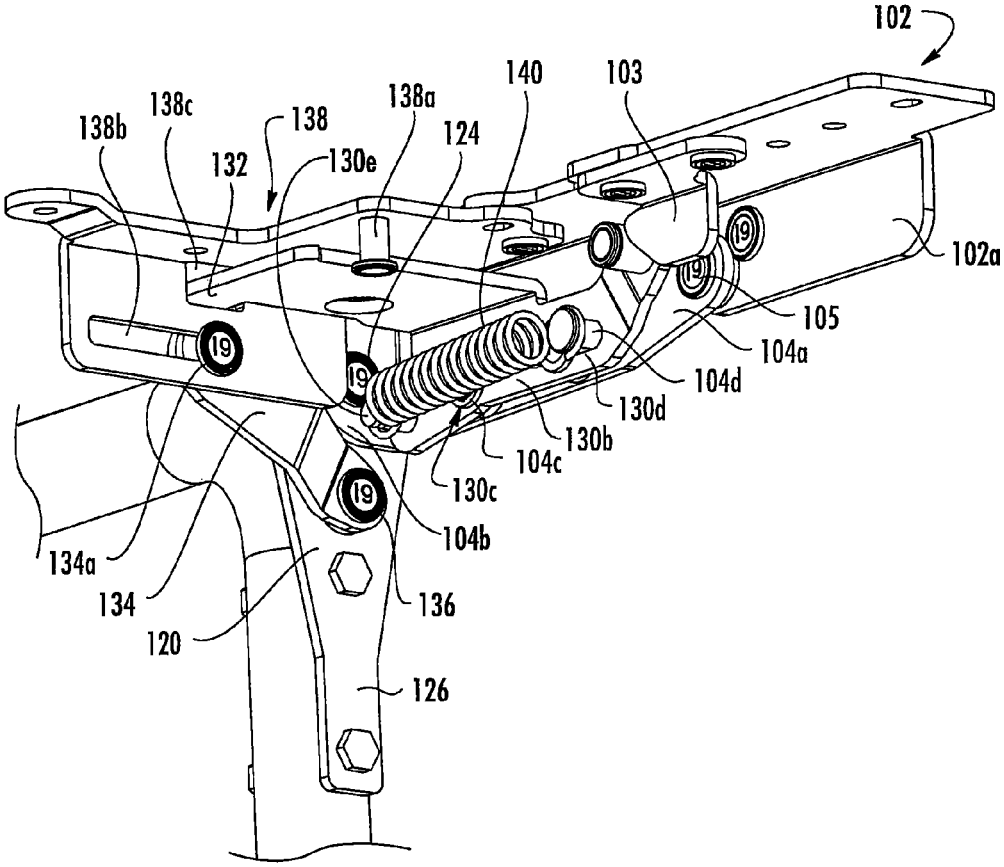
FIG. 13 is a rear, bottom perspective view of the rear leg of FIG. 11 shown in the unfolded position of FIG. 10.

Folding of the legs 94 is controlled by two leg folding mechanisms 100 as noted above (only one of which will be described herein). Each leg folding mechanism 100 includes a front intermediate section bracket 102 that is mounted beneath the foot end of the intermediate section 20; the front intermediate section bracket includes a vertical flange 102*a*, on which is mounted a cam 103 (FIG. 13). A seat section bracket 104 with a side flange 104*a* and an end flange 104*b* is mounted below the seat section 16. The brackets 102, 104, which are connected at a pivot 105, are adjacent to each other when the bed 15 is in the unfolded position of FIGS. 10 and 13.

Figure 9:
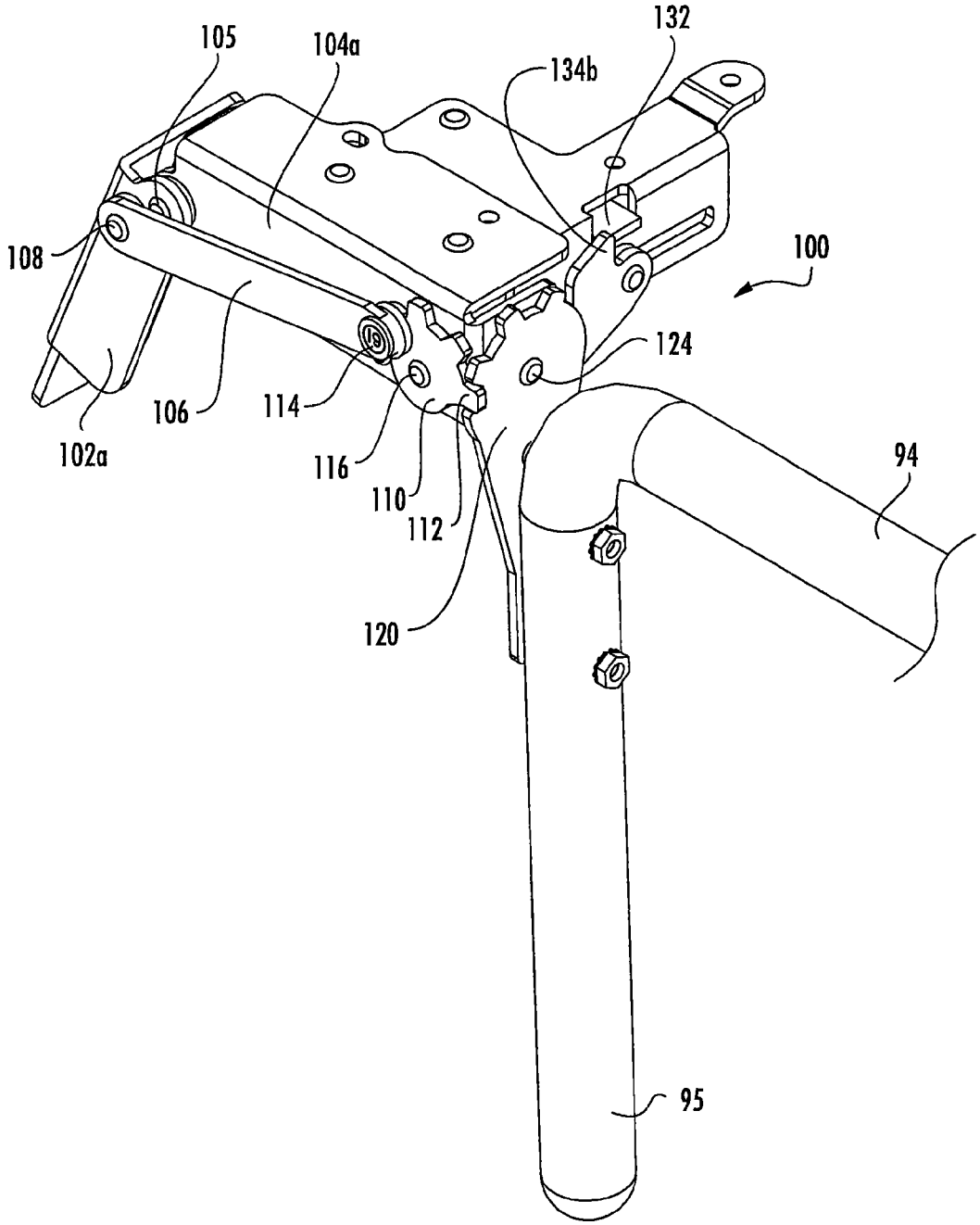
FIG. 9 is a front, bottom perspective view of one of the rear legs of the seating unit of FIG. 1 shown in the intermediate position of FIG. 3.
Figure 10:
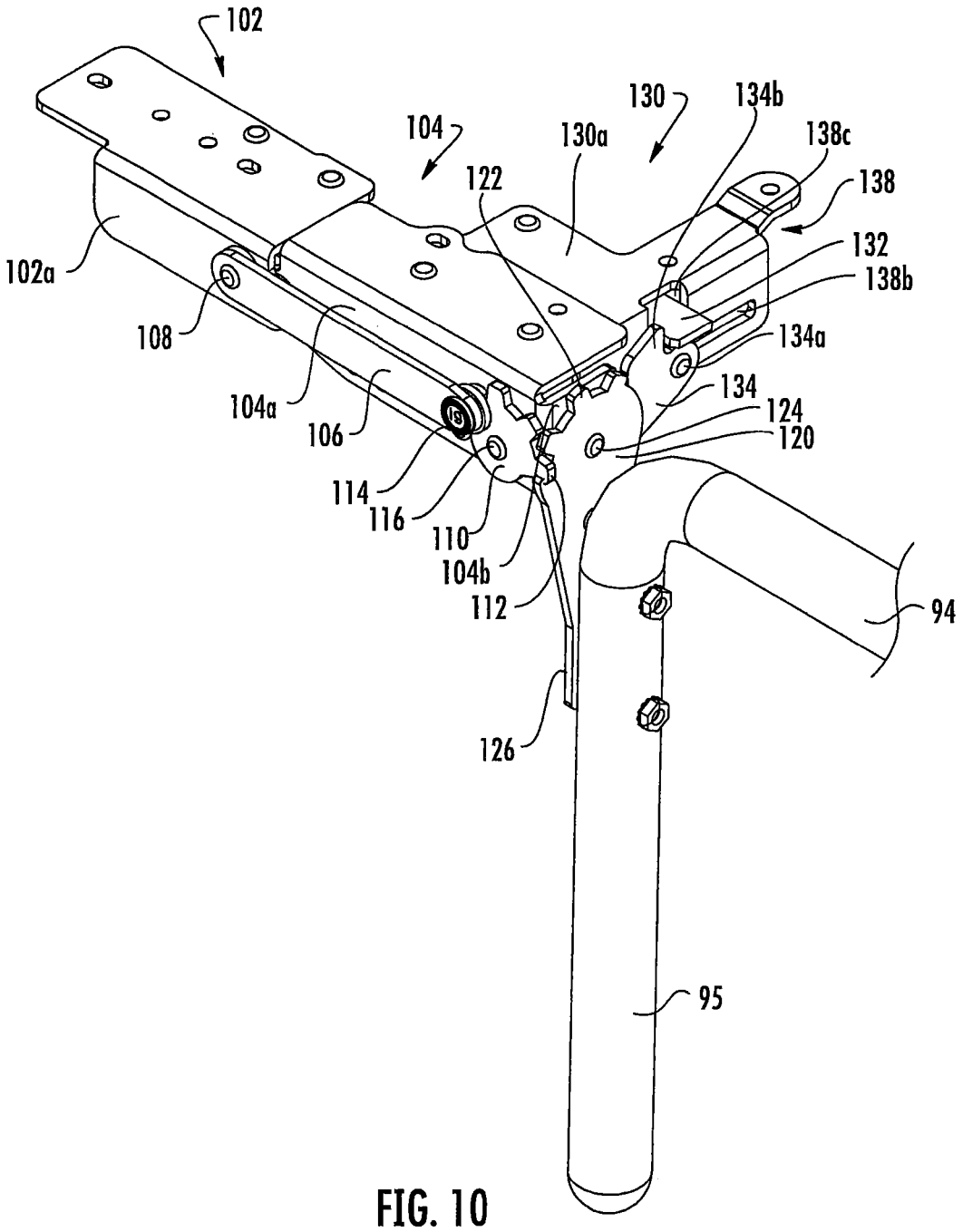
FIG. 10 is a front, bottom perspective view of the rear leg of FIG. 9 shown in the unfolded position.

Referring to FIGS. 9 and 10, a gear drive link 106 is mounted to the front intermediate section bracket 102 at a pivot 108 and extends forwardly therefrom. A gear 110 with teeth 112 is mounted to the seat section bracket 104 at a pivot 116 to rotate about a transverse axis. The gear drive link 106 is attached to the gear 110 at a pivot 114. A sprocket 120 with an extension 126 is fixed to one of the uprights 95 of the leg 94 and is attached to the end flange 104*b* of the seat mounting bracket 104 at a pivot 124 that defines a longitudinal pivot axis. The teeth 122 of the sprocket 120 mesh with the teeth 112 of the gear 110.

Figure 11:
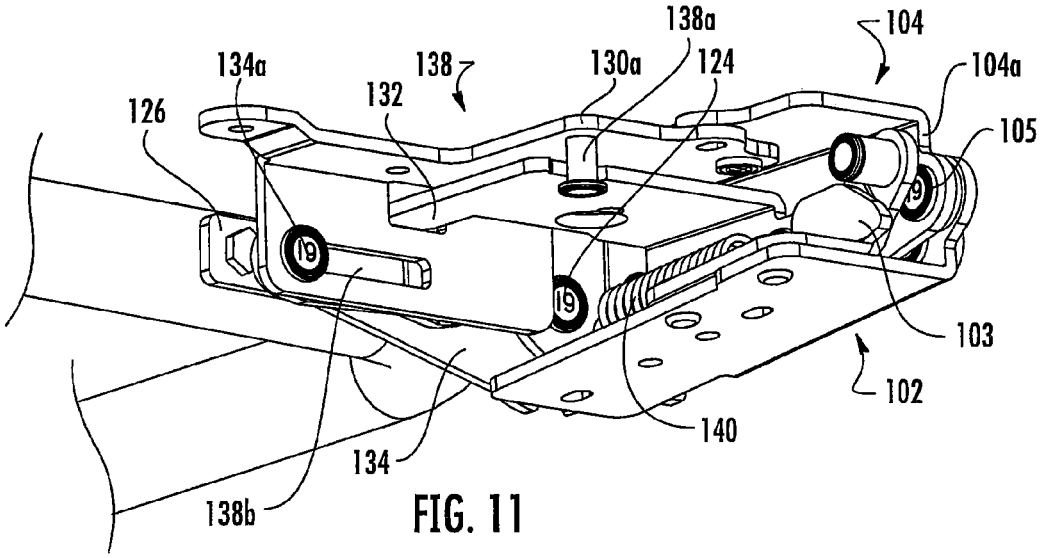
FIG. 11 is a rear, bottom perspective view of the rear leg of FIG. 9 shown in the folded position of FIG. 10.
Figure 12:
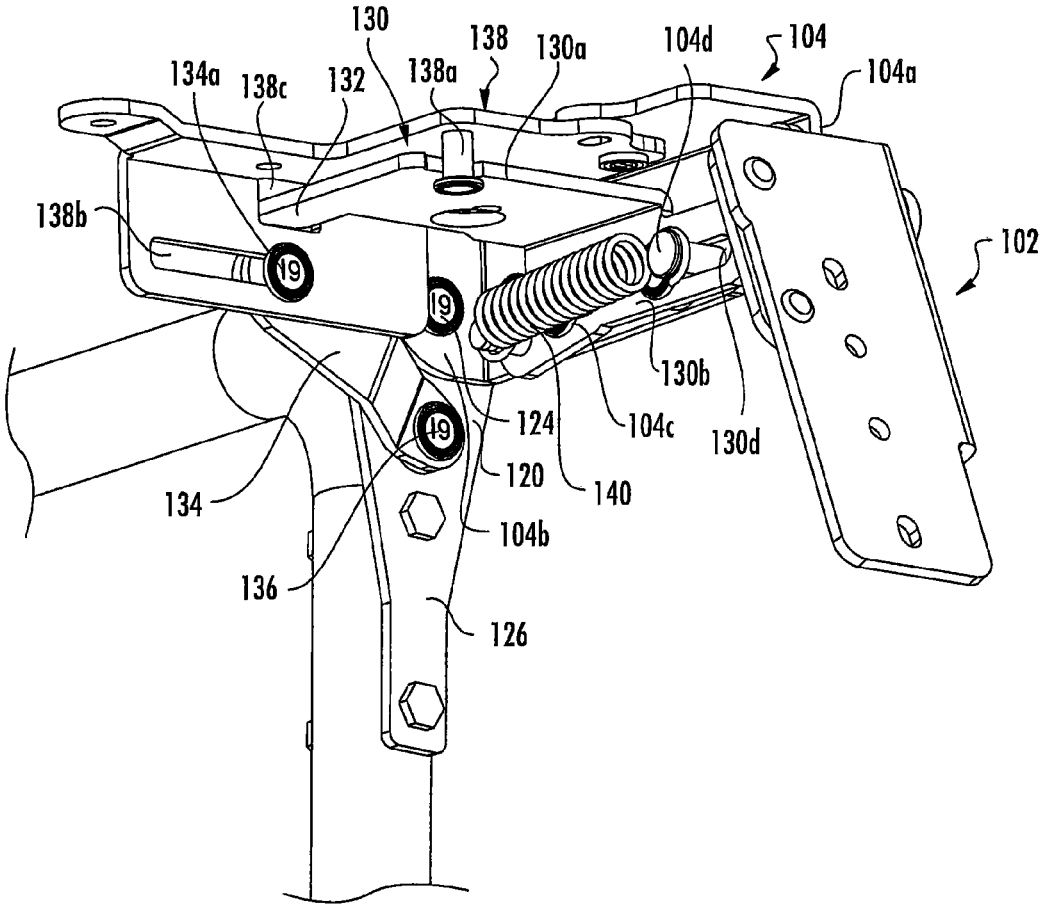
FIG. 12 is a rear, bottom perspective view of the rear leg of FIG. 11 shown in the intermediate position of FIG. 9.

Seen best in FIGS. 11-13, a stop link 130 has a horizontal panel 130*a* and a vertical panel 130*b*. Two slots 130*c*, 130*d* are present in the vertical panel 130*b* and receive, respectively, pins 104*c*, 104*d* mounted to the inner surface of the vertical flange 104*a* of the seat section bracket 104. A tab 132 extends forwardly from the horizontal panel 130*a*. A mounting extension 138 is fixed to and extends inwardly from the seat section bracket 104. A pin 138*a* extends downwardly from a horizontal panel of the mounting extension 138 and engages a recess in the rearward edge of the horizontal panel 130*a* of the stop link 130. The vertical panel of the mounting extension 138 has an aperture 138*c* through which the tab 132 extends. A brace 134 is pivotally attached to the sprocket extension 126 at a pivot 136. The opposite end of the brace 134 has a pin 134*a* that extends into a slot 138*b* in the vertical panel of the mounting extension 138. The brace 134 also has a projection 134*b* that engages the tab 132 when the bed 15 is in the unfolded position (see FIG. 10). A spring 140 is mounted to the side flange 104*a* of the seat section bracket 104 via the pin 104*d* and to the forward end of the stop link 130 at a post 130*e*.

Figure 7:
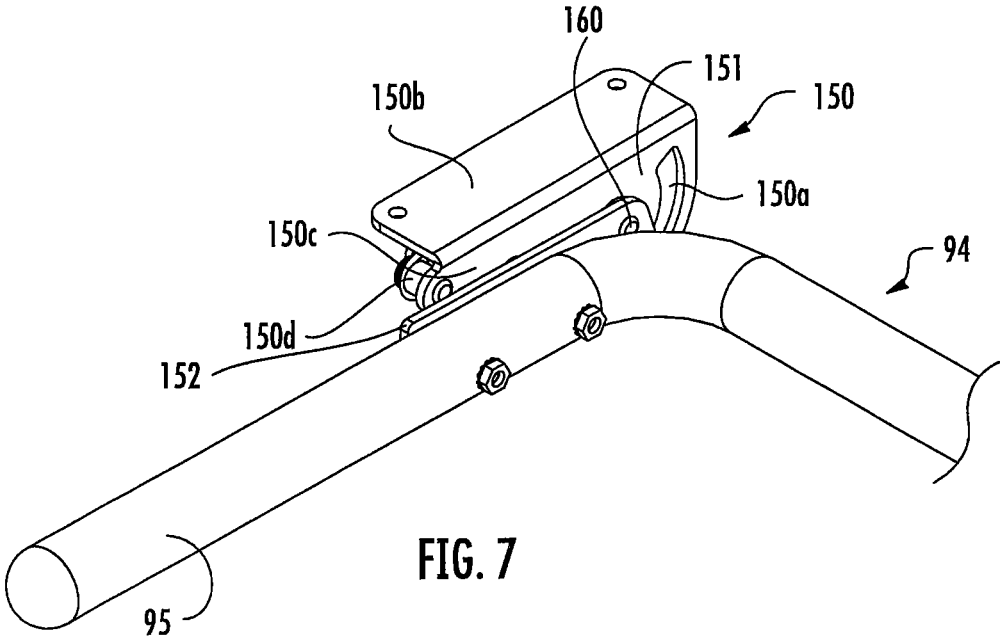
FIG. 7 is a rear perspective view of one of the front legs of the seating unit of FIG. 1 shown in the folded position of FIGS. 1 and 2.
Figure 8:
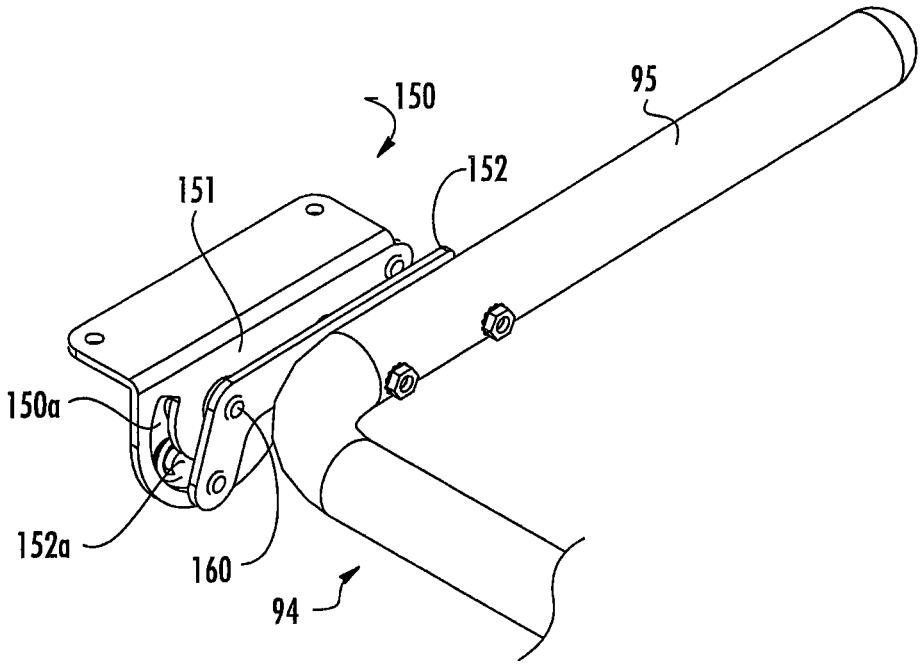
FIG. 8 is a front perspective view of the front leg of FIG. 7.

Referring now to FIGS. 7 and 8, a bracket 150 is mounted to the underside of the foot end of the seat section 16. A vertical panel 151 is fixed to the bracket 150 and includes a quarter-circular slot 150*a*. A tab 150*c* extends inwardly; a post 150*d* is mounted on the tab 150*c*. An extension member 152 is mounted to an upright 95 of the leg 94 and extends to a pivot 160 with the vertical panel 151. A branch of the extension member 152 extends laterally and includes a pin 152*a* that is received in the slot 150*a*. (Another embodiment of this portion of the leg folding mechanism is described in U.S. patent application Ser. No. 13/900,311, supra).

Referring back to FIGS. 2, 4 and 5, the bed 15 also includes a center leg assembly 180 which, as can be seen in FIG. 5, is mounted toward the center of the bed. The center leg assembly 180 includes a mounting bracket 184 fixed to the underside of the intermediate panel 22. Two center legs 182 are mounted to the mounting bracket 184 at pivots 186. Respective pneumatic cylinders 188 are attached to the mounting bracket 184 at pivots 189 and to the center legs 182 at pivots 190. A cross-member 192 spans lower portions of the center legs 192.

Figure 2:
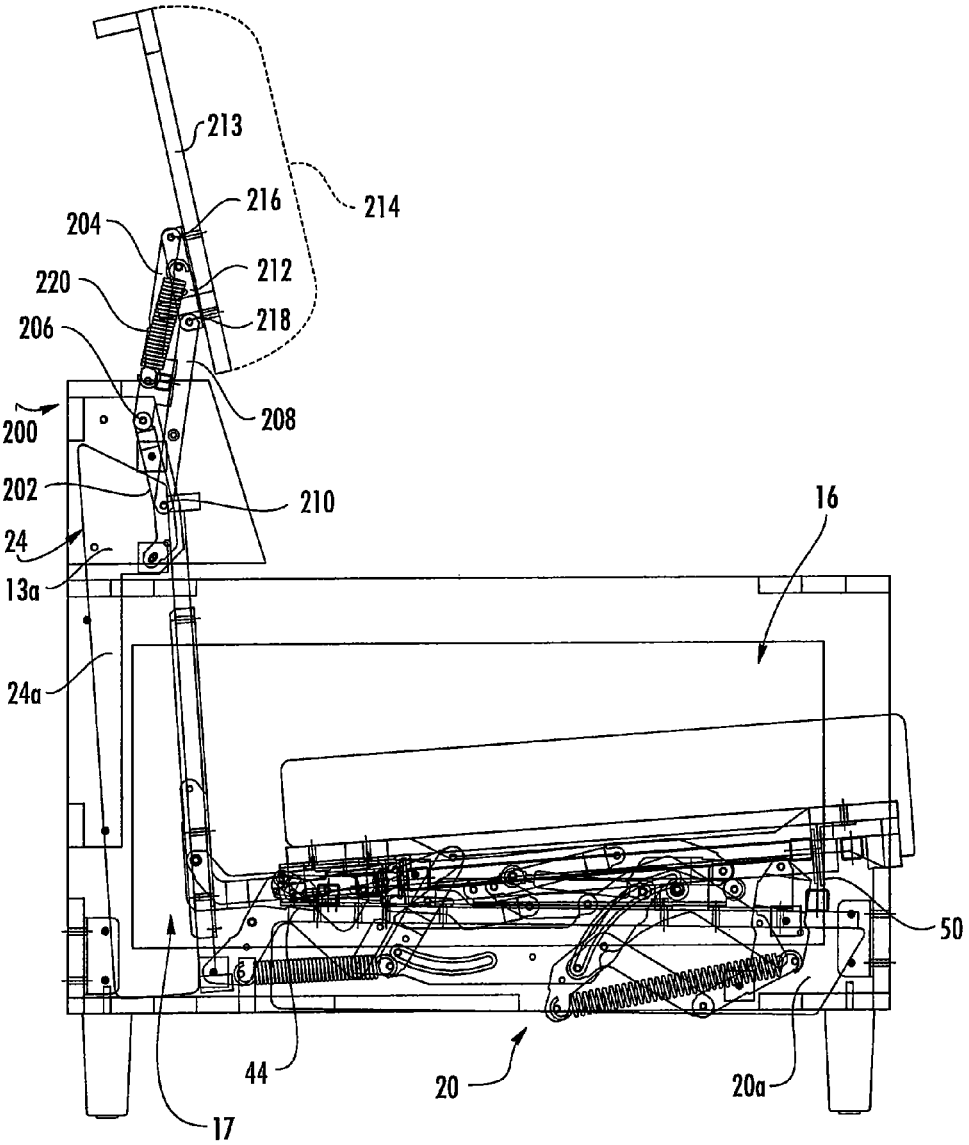
FIG. 2 is a side view of the seating unit of FIG. 1 with the backrest in a raised position.

The seating unit 10 also includes a backrest cushion assembly 200, which can be seen in FIGS. 1 and 2. The backrest cushion assembly 200 includes a mounting bracket 202 fixed to the side panels of the backrest 13*a*. Upper and lower swing links 204, 208 are attached to the mounting bracket 202 at, respectively, pivots 206, 210. A mounting bracket 212 is attached to the upper and lower swing links 204, 208 at pivots 216, 218. A backrest plate 213 (on which is mounted one or more backrest cushions 214) is fixed to the mounting bracket 212. A spring 220 is attached to the upper swing link 204 and the mounting bracket 212.

Figure 3:
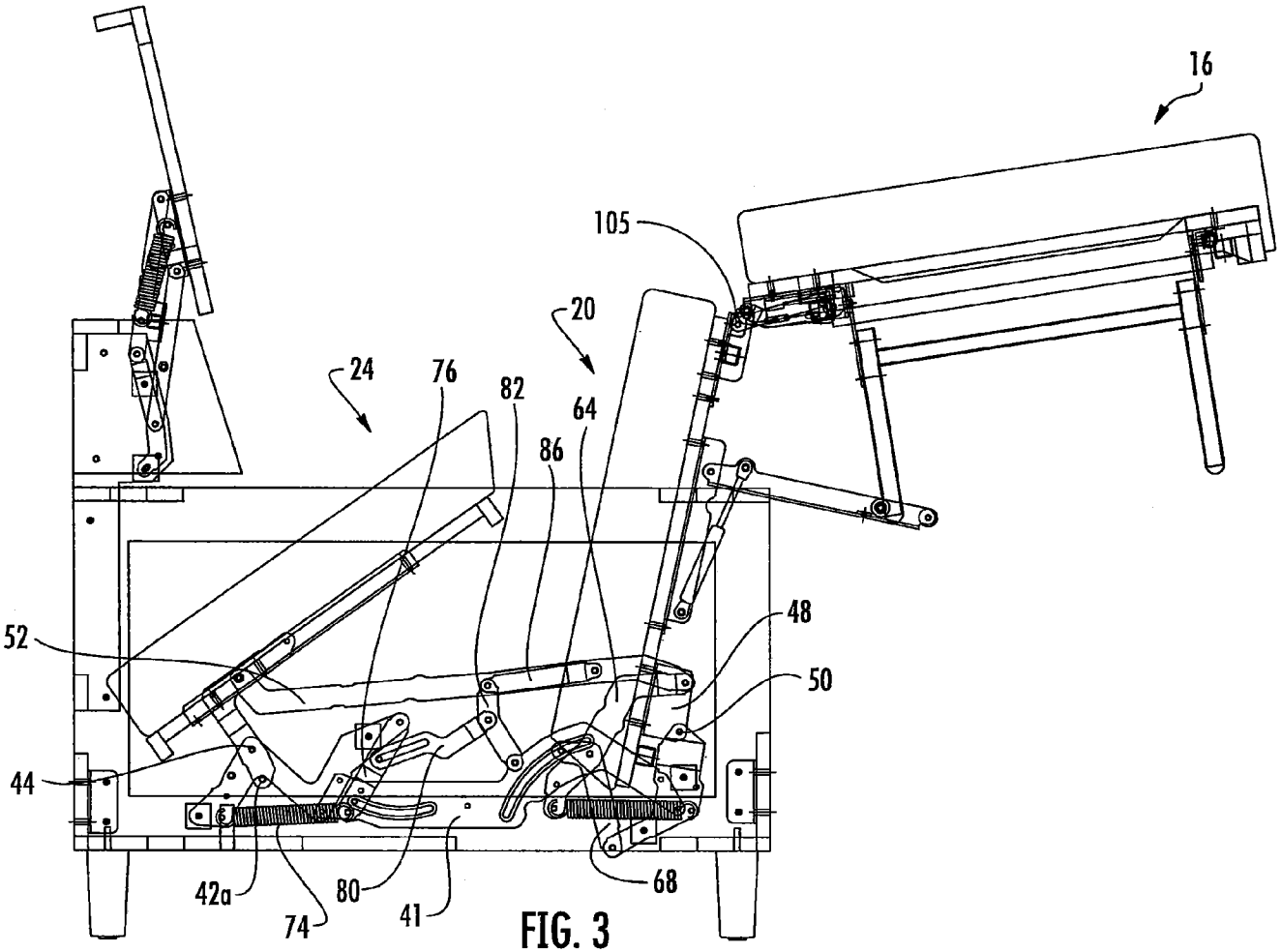
FIG. 3 is a side view of the seating unit of FIG. 1 with the bed in an intermediate position between the folded and unfolded positions.

To move the bed 15 from the unfolded position of FIGS. 4, 5, 6C and 6D to the folded position of FIGS. 1 and 2, a user lifts the front end of the seat section 16 and moves it rearwardly. This action also lifts the intermediate section 20, which, supported by the intermediate section bracket 48, begins to pivot relative to the base 11 (counterclockwise from the vantage point of FIGS. 2-4) about the pivot 50. As can be seen in FIG. 3, the seat section 16 remains generally horizontal as the intermediate section 20 pivots relative to it about the pivot 105. The rotation of the intermediate section 20 also forces the connecting link 52 rearwardly, which drives the head section 24 to rotate counterclockwise about the pivot 44. This motion continues until a pin 42*a* on the head section link 42 contacts the lower edge of the connecting link 52 (see FIG. 6A), at which point the head section 24 has reached its rearmost position within the cavity 17 and is generally upright (see FIG. 2). Rotation of the intermediate section 20 about the pivot 50 ceases when it reaches an inverted orientation within the cavity 17 (FIG. 2). The seat section 16 completes its motion in a generally horizontal but slightly pitched orientation (FIG. 2) in which a rail 18*a* mounted under the front end of the seat frame 18 rests atop the front wall 12.

The first portion of the folding action is assisted by the folding assist assembly 72. It can be envisioned from examination of FIGS. 3, 4, 6B and 6C that, as connecting link 52 drives the head section 24 about the pivot 44, the connecting link 52 also drives the transition link 86 rearwardly. This motion causes the control link 82 to rotate counterclockwise about the pivot 84. Rotation of the control link 82 forces the slotted link 80 rearwardly, such that the spring link 76 is drawn clockwise about the pivot 78 by tension in the spring 74. Thus, this portion of the folding movement is assisted by the tension in the spring 74; assistance ceases when, as shown in FIG. 3, the pin 76*a* of the spring link 76 reaches the rear end of the slot 41*b*.

Figure 6B:
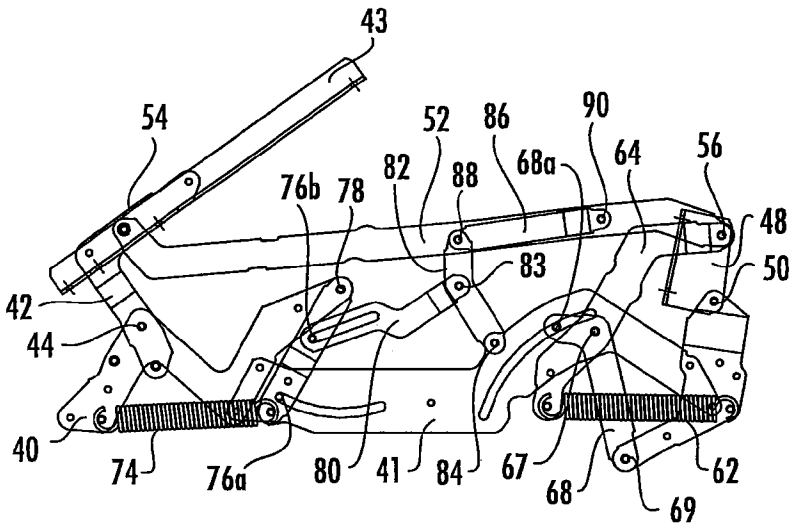
FIG. 6B is a side view of the unfolding mechanism of FIG. 6A, with the mechanism in the intermediate position of FIG. 3.
Figure 6A:
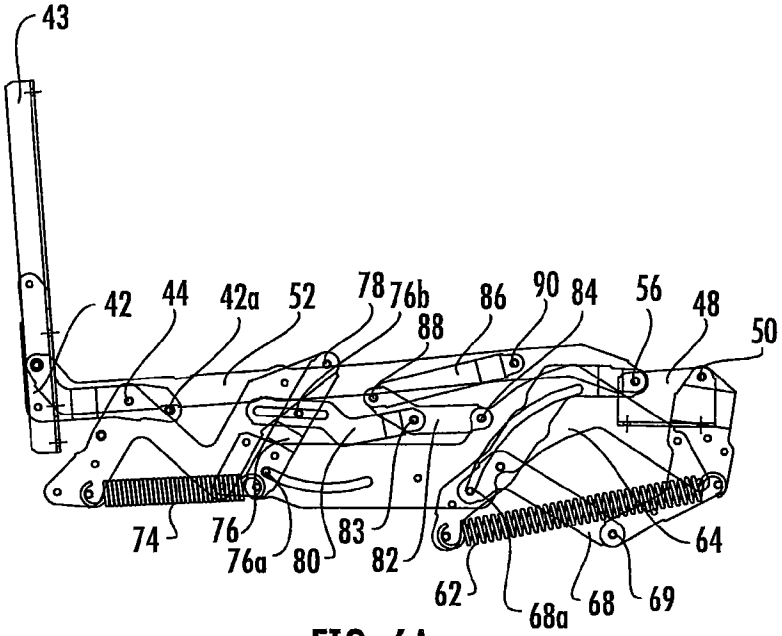
FIG. 6A is a side view of the unfolding mechanism of the seating unit of FIG. 1, with the mechanism in the folded position of FIGS. 1 and 2.
Figure 6C:
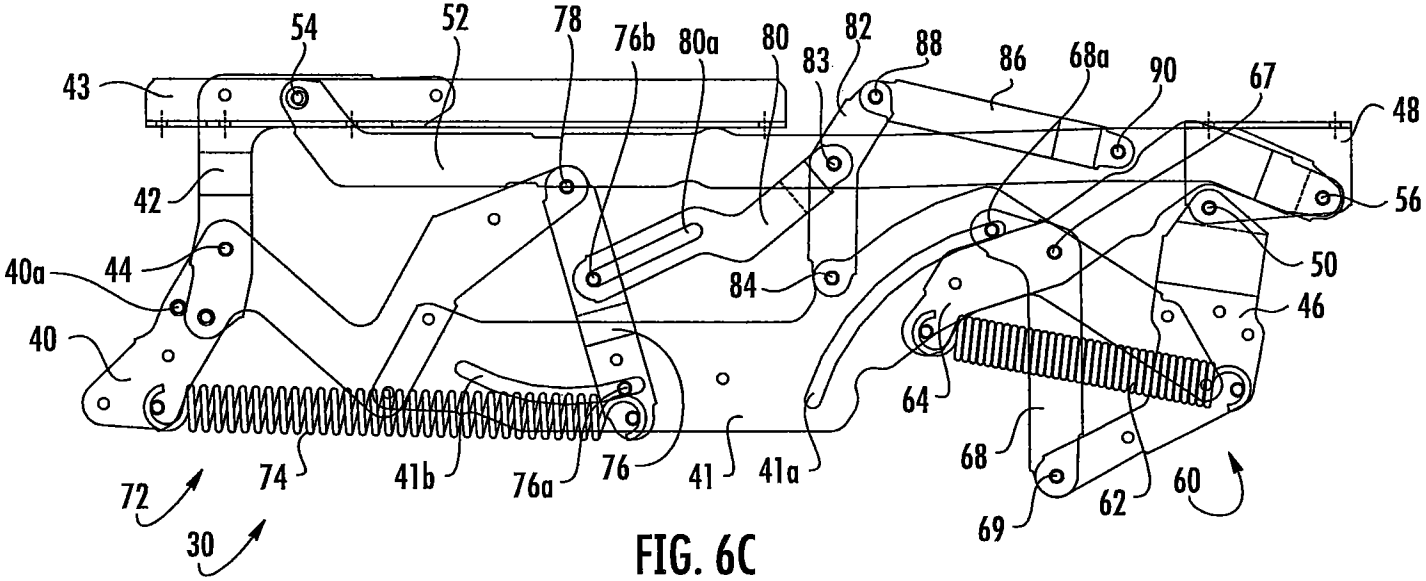
FIG. 6C is a side view of the unfolding mechanism of FIG. 6A, with the mechanism in the unfolded position of FIG. 4.
Figure 6D:
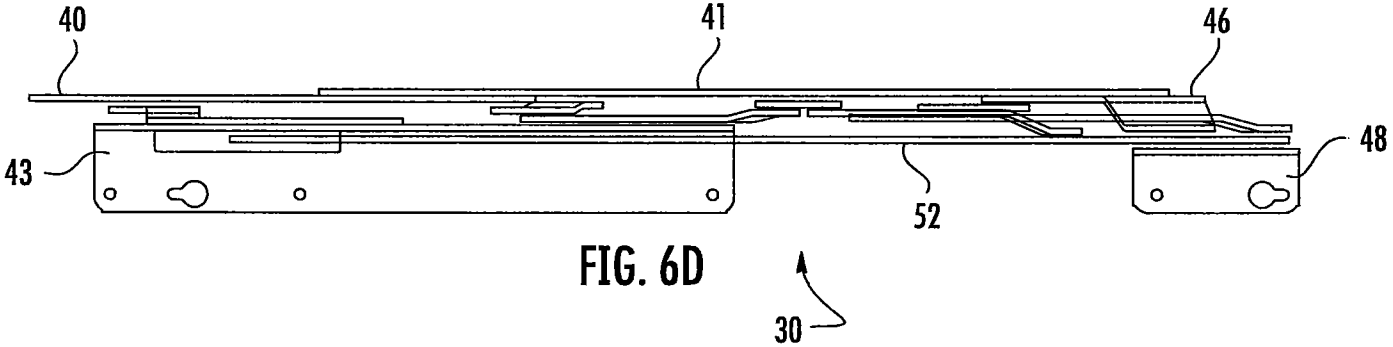
FIG. 6D is a top view of one half of the unfolding mechanism of FIG. 6A shown in the unfolded position of FIG. 4.

It can further be seen in FIGS. 2, 3, 6A and 6B that, as the intermediate section 20 rotates counterclockwise about the pivot 50 and drives the connecting link 52 rearwardly, the spring link 64 of the unfolding assist assembly 60 is driven rearwardly and rotates slightly counterclockwise about the pivot 67 relative to the control link 68; in addition, the control link 68 rotates slightly counterclockwise about the pivot 69. However, the spring 62 develops very little tension during this initial portion of the folding action. Once the folding assist assembly 72 has ceased to assist folding (FIGS. 3 and 6B), continued rearward movement of the connecting link 52 forces the spring link 64 rearwardly, which continues the counterclockwise rotation of the control link 68. Rotation of the control link 68 stretches the spring 62, thereby generating some resistance to folding of the bed 15 (which can help to prevent dropping or "slamming" of the bed 15 as it closes due to its weight). Rotation of the control link 58 ceases when the pin 68*a* reaches the rear end of the slot 41*a* (FIGS. 2 and 6A).

Referring now to FIGS. 7-13, folding of the legs 94 will be described. As can be seen in FIGS. 9, 10 and 13, in the unfolded position, the uprights 95 of the legs 94 extend downwardly away from the seat section 16. At the forward end of the legs 94, the pin 152*a* of the extension 152 is positioned in the upper end of the slot 150*a*. At the rearward end of the legs 94, and as seen in FIGS. 9, 10 and 13, the stop link 130 is positioned forwardly (held in that position by the cam 103), such that the pins 104*c*, 104*d* are positioned in the rear ends of the slots 130*c*, 130*d*, which places the spring 140 in tension. The tab 132 extends through the aperture 138*c* of the mounting extension 138; engagement of the tab 132 with the projection 134*b* prevents the pin 134*a* from moving inwardly in the slot 138*b*, which in turn prevents the sprocket 120 and attached leg 94 from rotating about the pivot 124. Such rotation is also prevented by the engagement of the teeth 122 of the sprocket 120 with the teeth 112 of the gear 110.

As an operator lifts the seat section 16 to move the bed 15 to the folded position, the pivoting of the intermediate section 20 relative to the seat section 16 about the pivot 105 rotates the cam 103 relative to the stop link 130, which enables the spring 136 to contract to draw the stop link 130 rearwardly, thereby drawing the tab 132 of the stop link 130 rearwardly in the aperture 138*c* of the mounting extension 138. After the tab 132 is sufficiently withdrawn to clear the projection 134 (FIGS. 9 and 12), the sprocket 120 and adjoined leg 94 are free to rotate about the pivot 124. The continued relative rotation of the intermediate section 20 and the seat section 16 draws the gear drive link 106 forwardly, which action rotates the gear 110 clockwise (from the vantage point of FIG. 9) about the pivot 116. Rotation of the gear 110 rotates the sprocket 120 about the pivot 124 such that the uprights 95 of the leg 94 pivot along a longitudinal axis and extend inwardly to fold underneath the seat section 16 and above the intermediate section 20 (FIGS. 2 and 11). During this rotation, the post 134*a* of the brace 134 moves inwardly in the slot 138*b* of the mounting extension 138. Rotation of the foot end upright 95 also rotates the extension 152 relative to the vertical panel 151 of the foot bracket 150 about the pivot 160, such that the pin 152*a* moves downwardly within the slot 150*a*, which provides stability and smoothness to the movement of the leg 94.

Unfolding of the bed 15 from the folded position of FIG. 1 to the unfolded position of FIGS. 4 and 6 is initiated by lifting the front edge of the seat section 16 and pulling it away from the base 11 of the seating unit 10. The bed folding mechanisms 30 and the leg folding mechanisms 100 reverse the movements described above to enable the bed 15 to unfold, with the legs 94 being fully extended downwardly when the gear drive link 106 is fully forward (approximately the position of FIGS. 3, 9 and 12) and becoming locked in the vertical disposition when the tab 132 enters the aperture 138*c* of the mounting extension 138*c* and engages the projection 134*b* of the brace 134 (FIGS. 4, 10 and 13). Movement ceases when the rear edge of the head section link 42 strikes a pin 40*a* on the rear mounting bracket 40 (FIG. 6C). The folding resist assembly 60 assists in the unfolding operation until the control link 68 rotates clockwise sufficiently that the tension in the spring 62 is substantially absent (approximately the point in the movement shown in FIGS. 3 and 6B). At essentially that point in the movement, the unfolding resist assembly 72 begins to resist the unfolding. The forward movement of the connecting link 52 draws the slotted link 80 forward, which rotates the spring link 76 counterclockwise about the pivot 78 and generates tension in the spring 74. This biasing of the bed 15 away from the unfolded position can prevent the bed 15 from slamming down into the unfolded position due to its weight.

Also, during unfolding of the bed 15, the center leg assembly 180 unfolds the center legs 182. In the folded position of FIG. 2, the center legs 182 are generally parallel with the intermediate section 20, and the pneumatic cylinders 188 are retracted. As the intermediate section 20 rotates away from the seat section 16, the pneumatic cylinders 188 force the center legs 182 to rotate about the pivots 186. Early in the unfolding action, the center legs 182 press against the seat panel 18 of the seat section 16; because the pneumatic cylinders are biased toward their extended positions, the contact of the center legs 182 against the seat panel 18 assists the bed 15 in unfolding. The center leg assembly 180 is fully extended when the pneumatic cylinders 188 are extended (FIG. 4).

Further, as shown in FIGS. 2-4, the cushion 24*a* of the head section 24 has a front edge that slopes rearwardly from top to bottom, and the cushion 20*a* of the intermediate section 20 has a rear edge that slopes forwardly from bottom to top. The rear edge of the cushion 24*a* meets the front edge of the cushion 20*a* to form a seam therebetween that is "tighter" than would be the case if the mating edges did not slope as described.

It should also be noted that, in FIGS. 2-4 that illustrate the folding and unfolding of the bed 15, the backrest cushion assembly 200 is in a raised position. In this position, the spring 220 is in tension. As such, it maintains an "over-center" condition between pivots 206, 210 and 218, which maintains the backrest cushion assembly 200 in the raised position. As can be seen in FIG. 1, the backrest cushion 214 can be lowered by applying a downward force to the backrest cushion 214 and/or backrest plate 213, which causes the upper and lower swing links 204, 208 to rotate clockwise about the pivots 206, 210. The upper and lower swing links 204, 208 rotate through an "on-center" condition (when the links 204, 208 are generally horizontal) after which the spring 220 biases the backrest cushion assembly 200 in the lowered position shown in FIG. 1. The assembly 200 typically remains in this position for much of the time the seating unit 10 is in use, only being raised when the bed 15 is to be unfolded.

Some advantages of the seating unit are described in U.S. patent application Ser. No. 13/900,311, supra. In addition, embodiments of the seated unit discussed and illustrated herein can provide additional advantages. For example, by positioning the head section 24 in a vertical orientation in the folded position, the designer may have more flexibility with the design of the cushions used in the seat, intermediate and head sections. Thicker cushions can be used for these sections, as only two sections (the seat and intermediate sections) are vertically stacked within the cavity of the base when the seating unit is in the folded position. This may provide more comfortable seating and/or more comfortable sleeping for occupants, and may enable a foldable bed of this type to be used in conjunction with a wider variety of sofas, including "off-the-floor" styles.

Also, by including the backrest cushion assembly 200, the designer has the flexibility to use any thickness cushion, rather than being confined to a certain thickness in the event that the head section of the bed also serves as the backrest. Moreover, in some furniture units the backrest cushions are removed and laid aside before the bed is unfolded. The backrest cushion assembly 200 keeps the backrest cushions in a neatly organized fashion even when the bed is unfolded.

In addition, the presence of the center leg assembly 180 can add stability to the bed 15 after it is unfolded and supporting an occupant. Further, the use of pneumatic cylinders or other means that bias the intermediate and seat sections toward the unfolded position when they are folded can assist in the act of unfolding the bed.

Those skilled in this art will appreciate that seating units according to embodiments of the present invention may take a number of different forms. For example, either or both of the folding assist unit and the folding resist unit may be omitted as desired. In addition, the mechanism employed to rotate the legs that support the seat section may vary. For example, rather than inducing rotation in the legs via intermeshing gears, the mechanism may employ a series of pivoting links. Also, while the illustrated embodiment is configured such that the legs are essentially fully unfolded by the intermediate position shown in FIGS. 3, 9 and 10, the mechanism may be configured so that the legs unfold either earlier or later in the movement of the bed.

Further, the configuration of the legs themselves may vary. For example, although each of the legs is illustrated as a single generally U-shaped member, it may be configured instead as a U-shaped loop. Alternatively, the seating unit may include four separate leg members, each a straight member, rather than two legs with two upright each. In other embodiments, only two or three uprights may be included rather than four. Other configurations may be apparent to those of skill in this art.

Finally, in some embodiments either or both of the center leg assembly 180 and the backrest cushion assembly 200 may be omitted.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit that includes a foldable bed, the seating unit comprising:

a base with an internal cavity and a rear wall;

a foldable bed that includes separate and distinct head, intermediate and seat sections, wherein in a folded position, the intermediate and seat sections are generally horizontally disposed and positioned in vertically stacked relationship, and the head section is generally a vertically disposed and positioned in the cavity adjacent a rear portion of the base with a support surface facing rearwardly, and in an unfolded position in the cavity, the head, intermediate and seat sections are generally horizontally disposed and in serial alignment with each other, with the support surface of the head section facing upwardly; and a bed folding mechanism that is attached to the base and the head, intermediate and seat sections that controls the movement of the bed between the folded and unfolded positions.

2. The seating unit defined in claim 1, wherein the head section pivots relative to the base about a single pivot axis in moving between the folded and unfolded positions.

3. The seating unit defined in claim 1, wherein the head section includes a cushion with a sloped front edge, and the intermediate section includes a cushion with a sloped rear edge.

4. The seating unit defined in claim 1, further comprising a backrest cushion assembly attached to the base that is movable between raised and lowered positions.

5. The seating unit defined in claim 1, further comprising: (a) a leg pivotally attached to the seat section and (b) a leg folding assembly mounted to the intermediate section and the seat section, wherein the leg is configured to reside between the intermediate and seat sections when the seating unit is in the folded position and under the seat section when the seating unit is in the unfolded position.

6. The seating unit defined in claim 5, wherein the leg pivots about a generally horizontal axis that is parallel with the longitudinal direction of the seating unit.

7. The seating unit defined in claim 5, wherein the leg is positioned between the intermediate section and the seat section in the folded position.

8. The seating unit defined in claim 1, wherein the bed folding mechanism includes a folding assist unit that biases the bed toward the folded position.

9. The seating unit defined in claim 1, wherein the bed folding mechanism includes a folding resist unit that biases the bed toward the unfolded position.

10. The seating unit defined in claim 1, further comprising a center leg assembly mounted to the intermediate section, the center leg assembly residing between the intermediate section and the seat section in the folded position and extending to support the intermediate section from underneath in the unfolded position.

11. The seating unit defined in claim 10, wherein the center leg assembly includes a biasing unit that biases the center leg assembly to extend, and wherein biasing of the center leg assembly to extend also biases the intermediate and seat sections toward the unfolded position.

12. A seating unit that includes a foldable bed, the seating unit comprising:

a base with an internal cavity and a rear wall;

a foldable bed that includes separate and distinct head, intermediate and seat sections, wherein in a folded position, the intermediate and seat sections are generally horizontally disposed and positioned in vertically stacked relationship, and the head section is generally a vertically disposed and positioned in the cavity adjacent a rear portion of the base with a support surface facing rearwardly, and in an unfolded position in the cavity, the head, intermediate and seat sections are generally horizontally disposed and in serial alignment with each other, with the support surface of the head section facing upwardly; and a bed folding mechanism that is attached to the base and the head, intermediate and seat sections that controls the movement of the bed between the folded and unfolded positions;

wherein the intermediate section and the seat section are pivotally attached to each other.

13. The seating unit defined in claim 12, wherein the head section includes a cushion with a sloped front edge, and the intermediate section includes a cushion with a sloped rear edge.

14. The seating unit defined in claim 12, further comprising a backrest cushion assembly attached to the base that is movable between raised and lowered positions.

15. The seating unit defined in claim 12, further comprising: (a) a leg pivotally attached to the seat section and (b) a leg folding assembly mounted to the intermediate section and the seat section, wherein the leg is configured to reside between the intermediate and seat sections when the seating unit is in the folded position and under the seat section when the seating unit is in the unfolded position.

16. The seating unit defined in claim 15, wherein the leg pivots about a generally horizontal axis that is parallel with the longitudinal direction of the seating unit.

17. The seating unit defined in claim 15, wherein the leg is positioned between the intermediate section and the seat section in the folded position.

18. The seating unit defined in claim 12 wherein the bed folding mechanism includes a folding assist unit that biases the bed toward the folded position.

19. The seating unit defined in claim 12, wherein the bed folding mechanism includes a folding resist unit that biases the bed toward the unfolded position.

20. The seating unit defined in claim 12, further comprising a center leg assembly mounted to the intermediate section, the center leg assembly residing between the intermediate section and the seat section in the folded position and extending to support the intermediate section from underneath in the unfolded position.

21. The seating unit defined in claim 20, wherein the center leg assembly includes a biasing unit that biases the center leg assembly to extend, and wherein biasing of the center leg assembly to extend also biases the intermediate and seat sections toward the unfolded position.

22. A seating unit that includes a foldable bed, the seating unit comprising:

a base with an internal cavity and a rear wall;

a foldable bed that includes separate and distinct head, intermediate and seat sections, wherein in a folded position, the intermediate and seat sections are generally horizontally disposed and positioned in vertically stacked relationship, and the head section is generally a vertically disposed and positioned in the cavity adjacent a rear portion of the base with a support surface facing rearwardly, and in an unfolded position in the cavity, the head, intermediate and seat sections are generally horizontally disposed and in serial alignment with each other, with the support surface of the head section facing upwardly; and a bed folding mechanism that is attached to the base and the head, intermediate and seat sections that controls the movement of the bed between the folded and unfolded positions;

wherein the intermediate section and the seat section are pivotally attached to each other; and wherein the head section pivots relative to the base about a single pivot axis in moving between the folded and unfolded positions.

* * * * *